US009971283B2

(12) United States Patent
Kitago et al.

(10) Patent No.: US 9,971,283 B2
(45) Date of Patent: May 15, 2018

(54) BELT CONVEYANCE APPARATUS AND IMAGE FORMING APPARATUS FOR REDUCED BELT BUCKLING

(71) Applicant: CANON KABUSHIKI KAISHA, Tokyo (JP)

(72) Inventors: Shinya Kitago, Abiko (JP); Hisashi Tsukijima, Toride (JP); Yuichi Tanabe, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/241,551

(22) Filed: Aug. 19, 2016

(65) Prior Publication Data

US 2017/0060043 A1 Mar. 2, 2017

(30) Foreign Application Priority Data

Aug. 31, 2015 (JP) ..... 2015-171507

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1615
USPC ..... 399/302
See application file for complete search history.

(56) References Cited

U.S. PATENT DOCUMENTS

2009/0148200 A1* 6/2009 Hara ..... G03G 15/161 399/302
2011/0135354 A1* 6/2011 Maruko ..... G03G 15/2053 399/329
2011/0200343 A1* 8/2011 Matsumoto ..... G03G 15/0131 399/31

FOREIGN PATENT DOCUMENTS

JP H10-291672 A 11/1998
JP 2000-275985 A 10/2000
JP 2002-2999 A 1/2002
JP 2008-039995 A 2/2008
JP 2014-089225 A 5/2014

* cited by examiner

*Primary Examiner* — Billy Lactaoen
(74) *Attorney, Agent, or Firm* — Canon U.S.A., Inc. IP Division

(57) ABSTRACT

A belt conveyance apparatus includes an endless belt conveyed while being supported by a plurality of support rollers in a tensioned state. The plurality of support rollers include a tension roller and a steering roller. The tension roller, which is disposed adjacent to and downstream of the steering roller in a conveyance direction of the endless belt, has a reverse crown shape in which end portions in a rotational axis direction each have an outer diameter larger than a middle portion.

19 Claims, 10 Drawing Sheets

BELT CONVEYANCE APPARATUS AND IMAGE FORMING APPARATUS FOR REDUCED BELT BUCKLING

BACKGROUND OF THE INVENTION

Field of the Invention

The present invention relates to a belt conveyance apparatus used in an image forming apparatus such as a copier using an electrophotography process or an electrostatic recording process, a printer, and a facsimile, and an image forming apparatus including the belt conveyance apparatus.

Description of the Related Art

An image forming apparatus using an electrophotography process or an electrostatic recording process, for example, typically includes a belt conveyance apparatus including an endless belt (hereinafter, may be simply referred to as a "belt") supported by a plurality of support rollers in a tensioned state. The belt is used as a carrier that carries and conveys a toner image or a recording medium on which a toner image is formed. Examples of the carrier that carries and conveys a toner image include a belt-shaped electrophotographic sensitive member (photosensitive belt) and an intermediate transfer member (intermediate transfer belt) configured to carry and convey a toner image transferred from a photoconductor to transfer the toner image onto a recording medium. Examples of the carrier that carries and conveys a recording medium on which a toner image is formed include a recording medium carrier (conveyance belt) configured to carry and convey a recording medium to which the toner image is transferred from the photoconductor.

An example of the image forming apparatus using an electrophotography process, which includes an intermediate transfer belt, is further described. In general, the intermediate transfer belt configured to be supported by a plurality of support rollers in a tensioned state and rotated (conveyed) may be displaced toward one end in the width direction, which is a direction substantially perpendicular to a conveyance direction, during the rotation. This problem is called "belt deviation (meandering)". The belt deviation may be caused by factors, such as a low outer diameter accuracy of each support roller and low relative alignment accuracy between the support rollers.

As a measure to solve the problem of the belt deviation, Japanese Patent Laid-Open No. 2002-2999 discloses a technique in which at least one of support rollers is tilted against the other support rollers to move the intermediate transfer belt in a direction opposite to the direction of displacement in the width direction of the intermediate transfer belt.

However, when the steering roller is tilted on a predetermined trajectory as described in Japanese Patent Laid-Open No. 2002-2999, the tilting may destroy the parallel relationship between the steering roller and the other support rollers in the conveyance direction of the intermediate transfer belt. This may cause a stretched surface of the intermediate transfer belt to have a difference in tension in the width direction of the intermediate transfer belt at a position adjacent to a portion wound around the steering roller. Thus, in particular, the stretched surface of the intermediate transfer belt between the steering roller and the support roller (upstream roller), which is positioned adjacent to and upstream of the steering roller in the conveyance direction of the intermediate transfer belt, is readily waved. The wave typically extends radially from a high-tensioned portion of the stretched surface, which is close to the steering roller, toward an upstream side of the intermediate transfer belt in the conveyance direction of the intermediate transfer belt.

If the intermediate transfer belt is waved while traveling, the wave generally disappears at the portion of the intermediate transfer belt to be wound around the steering roller. However, if the wave protrudes such that the height of the wave is larger than the width of the wave, the intermediate transfer belt may be buckled at the portion to be wound around the steering roller. As a result, the intermediate transfer belt may have a crease. If the intermediate transfer belt has a crease, an output image may have a crease, resulting in an image defect. In addition, once the intermediate transfer belt has a crease, the crease is unlikely to be readily smoothed out.

SUMMARY OF THE INVENTION

The present invention provides a belt conveyance apparatus including an endless belt carrying a toner image and a plurality of support rollers supporting the endless belt from an inner surface side of the endless belt in a tensioned state, the plurality of support rollers including a steering roller, a first roller, and a second roller, wherein the steering roller is configured to move the endless belt in a width direction of the endless belt when tilted with respect to the first roller, the width direction intersecting a traveling direction of the endless belt, the first roller is disposed adjacent to and upstream of the steering roller in the traveling direction of the endless belt, and the second roller is disposed adjacent to and downstream of the steering roller in the traveling direction of the endless belt, the second roller having a reverse crown shape in which end portions in a rotational axis direction each have a larger outer diameter than a middle portion.

The present invention also provides an image forming apparatus including an endless belt, a toner image forming unit configured to form a toner image on the endless belt, and a plurality of support rollers supporting the endless belt from an inner surface side of the endless belt in a tensioned state, the plurality of support rollers including a steering roller, a first roller, and a second roller, wherein the steering roller is configured to move the endless belt in a width direction of the endless belt when tilted with respect to the first roller, the width direction intersecting a traveling direction of the endless belt, the first roller is disposed adjacent to and upstream of the steering roller in the traveling direction of the endless belt, and the second roller is disposed adjacent to and downstream of the steering roller in the traveling direction of the endless belt, the second roller having a reverse crown shape in which end portions in a rotational axis direction each have a larger outer diameter than a middle portion.

Further features of the present invention will become apparent from the following description of exemplary embodiments with reference to the attached drawings.

DESCRIPTION OF THE EMBODIMENTS

Hereinafter, a belt conveyance apparatus and an image forming apparatus according to the present invention are described further in detail with reference to the drawings.

First Embodiment

1. Overall Configuration and Operation of Image Forming Apparatus

Figure 1:
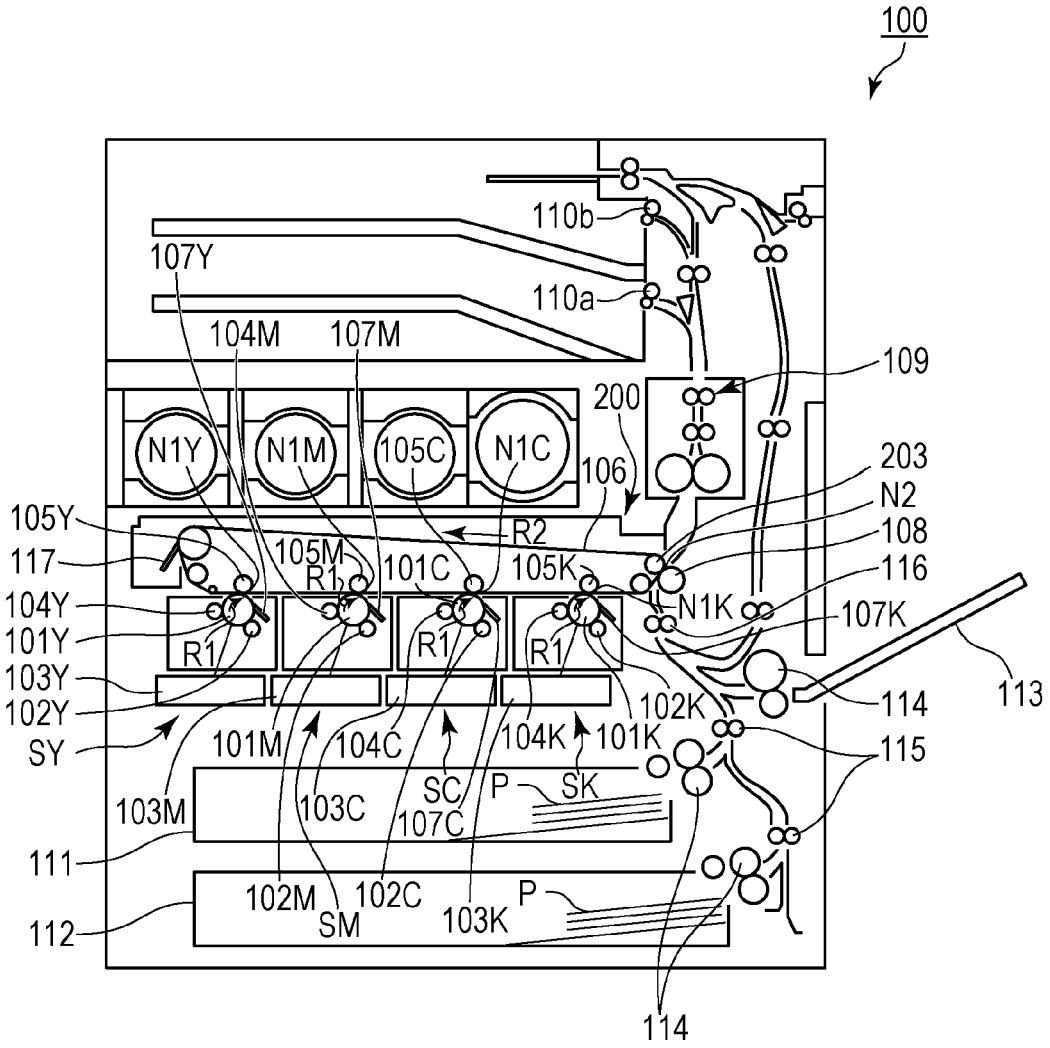
FIG. 1 is a schematic cross-sectional view of an image forming apparatus.

FIG. 1 is a schematic cross-sectional view of an image forming apparatus according to an embodiment of the present invention. An image forming apparatus 100 of this embodiment is a tandem color digital printer using an intermediate transfer process. The image forming apparatus 100 is configured to form a color image by using an electrophotography process.

The image forming apparatus 100 includes first, second, third, and fourth image forming sections SY, SM, SC, and SK configured to form images in yellow (Y), magenta (M), cyan (C), and black (K), respectively, as a plurality of image forming sections (stations). In this embodiment, the image forming sections SY, SM, SC, and SK are substantially the same in the configuration and the operation, except that each image forming section SY, SM, SC, and SK uses a toner in a different color in a development step. Hereinafter, when the image forming sections SY, SM, SC, and SK do not need to be distinguished from each other, the suffixes Y, M, C, and K, which indicate the colors, may be omitted and the image forming sections are collectively described.

Each image forming section S includes a photosensitive drum 101, which is a drum type electrophotographic photoconductive member (photoconductor), as an image carrier. The photosensitive drum 101 is configured to rotate in a direction indicated by an arrow R1 in FIG. 1. In the image forming section S, the following various devices are disposed around the photosensitive drum 101. The various devices include a charging roller 102, which is a roller type charging member as a charging unit, a laser scanner 103 as an exposing unit, a developer 104 as a developing unit, a primary transfer roller 105, which is a roller type primary transfer member as a primary transfer unit, and a drum cleaner 107 as a photoconductor cleaning unit.

The charging roller 102 is configured to substantially uniformly charge the surface of the rotating photosensitive drum 101 to a predetermined potential of predetermined polarity (negative polarity in this embodiment). The charged surface of the photosensitive drum 101 is exposed to a light emitted by the laser scanner 103 in accordance with an image signal, and thus a latent image (electrostatic image) corresponding to the image signal is formed on the photosensitive drum 101. The laser scanner 103 is configured to receive an image signal corresponding to the image forming section S and apply a laser light to the surface of the photosensitive drum 101 in accordance with the image signal so as to neutralize the charge on the photosensitive drum 101 and form a latent image. The latent image formed on the photosensitive drum 101 is developed by the developer 104 using a toner as a developing agent. In this embodiment, a toner charged to the same polarity as the charge polarity of the photosensitive drum 101 (negative polarity in this embodiment) is attached to an exposed portion of the photosensitive drum 101 where the absolute value of the potential is lowered by being exposed to the light after uniformly charged (reverse development).

The image forming apparatus 100 includes an intermediate transfer belt 106, which is an intermediate transfer member composed of an endless belt, so as to face the photosensitive drums 101 in the image forming sections S. The intermediate transfer belt 106 is configured to rotate in a direction indicated by an arrow R2 in FIG. 1. The primary transfer rollers 105 are positioned on an inner surface side of the intermediate transfer belt 106 so as to face the photosensitive drums 101 in the image forming sections S. The primary transfer rollers 105 are biased (pressed) against the photosensitive drums 101 with the intermediate transfer belt 106 therebetween to form primary transfer portions (primary transfer nips) N1 where the intermediate transfer belt 106 and the photosensitive drums 101 are in contact with each other. In addition, a secondary transfer roller 108, which is a roller type secondary transfer member as a secondary transfer unit, is disposed on an outer surface side of the intermediate transfer belt 106 so as to face a secondary transfer opposing roller 203, which is one of the support rollers supporting the intermediate transfer belt 106 in a tensioned state. The secondary transfer roller 108 is biased (pressed) against the secondary transfer opposing roller 203 with the intermediate transfer belt 106 therebetween to form a secondary transfer portion (secondary transfer nip) N2 where the intermediate transfer belt 106 and the secondary transfer roller 108 are in contact with each other. The primary transfer roller 105, the intermediate transfer belt 106, and the plurality of support rollers, which support the intermediate transfer belt 106 in a tensioned state, for example, constitute an intermediate transfer unit 200, which is a belt conveyance apparatus in this embodiment. The intermediate transfer unit 200 is described further in detail later.

The toner image formed on the photosensitive drum 101 is electrostatically transferred (primary transferred) onto the rotating intermediate transfer belt 106 by the primary transfer roller 105 at the primary transfer portion N1. At this time, the primary transfer roller 105 is supplied with a primary transfer bias of the polarity opposite the charge polarity of the toner during the development (regular charge polarity). In the case of the formation of a full-color image, for example, which is described later, the toner images in different colors formed on the corresponding photosensitive drums 101 in the image forming sections S are sequentially transferred onto the intermediate transfer belt 106 at the primary transfer portions N1 so as to overlap with each other. As a result, a multilayered toner image for a full color image is formed on the intermediate transfer belt 106. A residual toner remaining on the photosensitive drum 101 after the primary transfer step (untransferred toner in the primary transfer) is removed from the photosensitive drum 101 by the drum cleaner 107 and collected.

A recording material (image receiving medium, recording medium, sheet) P such as paper sent from a cassette 111, 112, or manual tray 113 is sent to a resist roller 116 by a feeding roller 114 or a transportation roller 115, for example. Then, after an end of the recording material P comes in contact with the stopped resist roller 116 and forms a loop, the resist roller 116 start rotating in synchronization with the toner image on the intermediate transfer belt 106 to transport the recording medium P to the secondary transfer portion N2.

The toner image on the intermediate transfer belt 106 is electrostatically transferred (secondary transferred) onto the recording medium P by the secondary transfer roller 108 at the secondary transfer portion N2. At this time, the secondary transfer roller 108 is supplied with a secondary transfer bias of the polarity opposite to the charge polarity of the regular charge polarity of the toner. A residual toner remaining on the intermediate transfer belt 106 after the secondary transfer step (untransferred toner in the secondary transfer) is removed from the intermediate transfer belt 106 by a belt cleaner 117 and collected.

The recording material P to which the toner image is transferred is sent to a fixing device 109 as a fixing unit where the toner image is fixed on the recording material P by heat and pressure. Then, the recording material P is ejected to the outside of the image forming apparatus 100 through one of ejection portions 110*a* and 110*b*.

In this embodiment, the image forming sections SY, SM, SC, and SK constitute a toner image forming unit configured to form a toner image on the intermediate transfer belt 106.

2. Intermediate Transfer Unit

Next, a schematic configuration of the intermediate transfer unit 200 as the belt conveyance apparatus in this embodiment is described.

Here, a direction (width direction) substantially perpendicular to the conveyance direction (traveling direction) of the intermediate transfer belt 106 may be also referred to as a thrust direction. The thrust direction is substantially parallel to a direction of a rotation axis of each of the photosensitive drums 101 and the support rollers 201 to 205. A "front side" and "rear side" of the image forming apparatus 100 are respectively a side facing to the viewer and a side facing away from the viewer in the thrust direction in FIG. 1. In addition, an up-down direction of the image forming apparatus 100 is an up-down direction in the vertical direction, but not limited to a straight up and down direction, and may include an obliquely above and below the horizontal at a reference position or reference component. In addition, when the positional relationship between positions or components in the image forming apparatus 100 is described, the image forming apparatus 100 is regarded as being set in a normal position.

Figure 2:
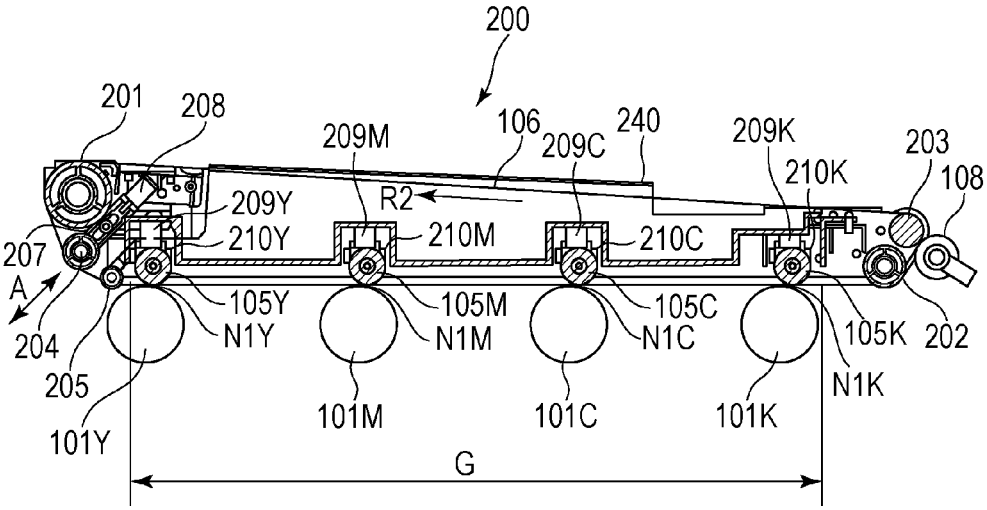
FIG. 2 is a schematic cross-sectional view of an intermediate transfer unit.

FIG. 2 is a schematic cross-sectional view of the intermediate transfer unit 200 (the photosensitive drums 101 and the secondary transfer roller 108 are also illustrated). The intermediate transfer unit 200 includes the intermediate transfer belt 106 as an intermediate transfer member. In this embodiment, the intermediate transfer belt 106 is an endless belt (film) formed of polyimide. The material of the intermediate transfer belt 106 is not limited to polyimide, and may be a resin such as PVDF (polyvinylidene fluoride), polyamide, PET (polyethylene terephthalate), or polycarbonate. The intermediate transfer belt 106 is supported by five support rollers including a drive roller 201, a tension roller 204, an auxiliary roller 205, an idler roller 202, and a secondary transfer opposing roller 203 in a tensioned state.

Four photosensitive drums 101 are arranged in a substantially straight line extending in the conveyance direction of the intermediate transfer belt 106. In this embodiment, the four photosensitive drums 101 are arranged in a substantially horizontal direction. More specifically, in this embodiment, the four photosensitive drums 101 are arranged in a substantially straight line such that a common tangent line on a side adjacent to the intermediate transfer unit 200 extends in a substantially horizontal direction.

The drive roller 201 is rotated by a belt drive motor 270 (FIG. 3) as a drive source and rotates (circulates or moves) the intermediate transfer belt 106 in the direction indicated by the arrow R2 in FIG. 2. The surface of the drive roller 201 is formed of a rubber layer having a high friction coefficient so as to prevent the intermediate transfer belt 106 from slipping. The drive roller 201 also functions as a steering roller for correcting the belt deviation, which is described in detail later. A structure for supporting the drive roller 201 is described in detail later.

The tension roller 204 is rotatably supported by bearings 207 at end portions in a rotational axis direction thereof. The bearings 207 are attached to a frame 240, which is described later, in a movable manner in a direction indicated by an arrow A in FIG. 2 (direction from the inner surface side of the intermediate transfer belt 106 toward the outer surface side, or the opposite direction). The bearings 207 are each biased by a tension spring 208, which is a biasing unit, from the inner surface side of the intermediate transfer belt 106 toward the outer surface side. Thus, the tension roller 204 is biased from the inner surface side of the intermediate transfer belt 106 toward the outer surface side so as to apply a pressure to the inner surface of the intermediate transfer belt 106. In this embodiment, the tension spring 208 is a compressed coil spring, which is an elastic member, and is disposed between the bearings 207 and a supporting surface of the frame 240 in a compressed state. The tension roller 204 is described further in detail later.

The auxiliary roller 205 and the idler roller 202 provide an image transfer surface G therebetween. The image transfer surface G, to which the toner image is transferred from the photosensitive drums 101, extends substantially in a planer shape. The auxiliary roller 205 is rotatably supported by the frame 240 at end portions in a rotational axis direction thereof by using bearings (not illustrated).

The idler roller 202 and the auxiliary roller 205 provide the image transfer surface G therebetween. The idler roller 202 is rotatably supported by the frame 240 at end portions in the rotational axis direction thereof by using bearings (not illustrated).

The secondary transfer opposing roller (secondary transfer inner roller) 203 and the secondary transfer roller (secondary transfer outer roller) 108 provide the secondary transfer portion N2 with the intermediate transfer belt 106 being sandwiched therebetween. The secondary transfer opposing roller 203 is rotatably supported by the frame 240 at end portions in the rotational axis direction by using bearings (not illustrated).

The intermediate transfer unit 200 includes the above-described primary transfer rollers 105Y, 105M, 105C, and 105K. The primary transfer rollers 105Y, 105M, 105C, and 105K are disposed so as to face the corresponding photosensitive drums 101Y, 101M, 101C, and 101K with the intermediate transfer belt 106 therebetween. The primary transfer rollers 105 are disposed between the auxiliary roller 205 and the idler roller 202 in the conveyance direction of the intermediate transfer belt 106. The primary transfer rollers 105 are each rotatably supported by bearings 210, which are rotatably attached to the frame 240, at end portions in the rotational axis direction. The bearings 210 are each biased against the photosensitive drum 101 by a primary transfer spring 209, which is a biasing unit. In this embodiment, the primary transfer spring 209 is a compressed coil spring, which is an elastic member, and is disposed between the frame 240 and the bearing 210 in a compressed state. The primary transfer rollers 105 and the corresponding photosensitive drums 101 sandwich the intermediate transfer belt 106 and provide the primary transfer portions N1 therebetween.

3. Steering Mechanism

Next, a steering mechanism is described. The steering mechanism is configured to correct the position of the intermediate transfer belt 106 in the width direction (hereinafter, may be simply referred to as a belt position), which is displaced due to the belt deviation, such that the belt position is brought back to a substantially middle position.

In this embodiment, the drive roller 201, which rotates the intermediate transfer belt 106, also functions as a steering roller, which is one of the plurality of support rollers supporting the intermediate transfer belt 106 in a tensioned state. The steering roller is configured to tilt with respect to the other support rollers to correct the belt position. However, the present invention is not limited to the configuration in which the steering roller is the drive roller. For example, in a supporting structure similar to that in FIG. 2, the idler roller 202 or the secondary transfer opposing roller 203 may be used as the drive roller such that the steering roller and the drive roller are different support rollers.

Figure 3:
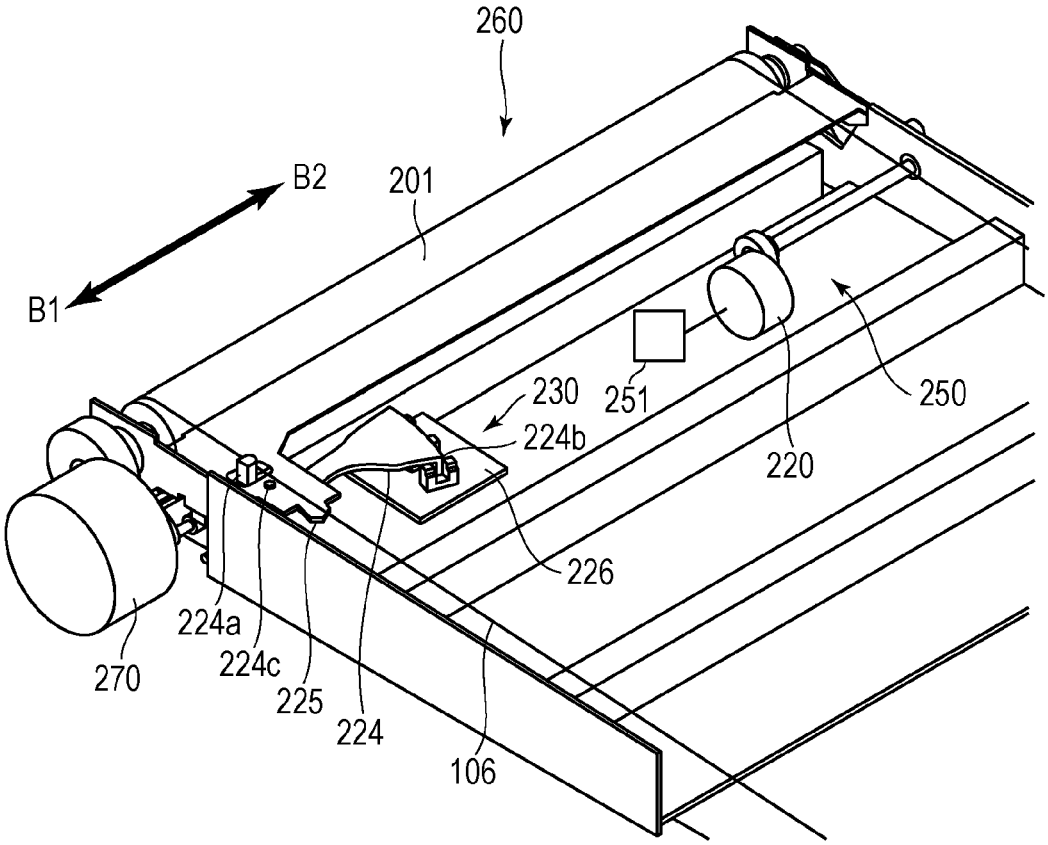
FIG. 3 is a schematic perspective view of a steering roller and peripheral portions thereof.
Figure 4A:
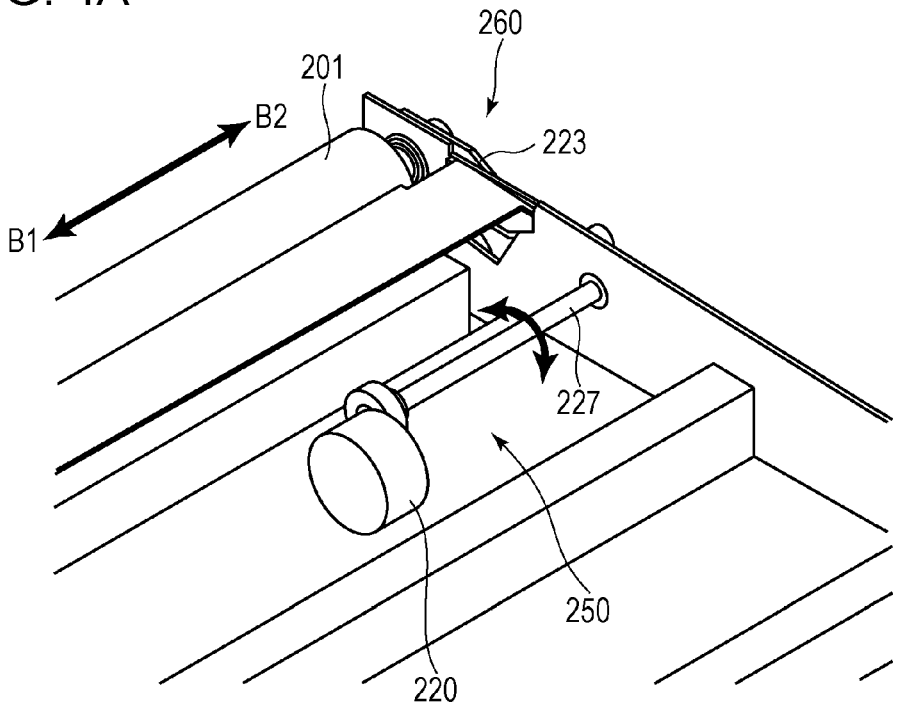
FIGS. 4A and 4B are schematic perspective views of a steering drive unit and peripheral portions thereof.
Figure 4B:
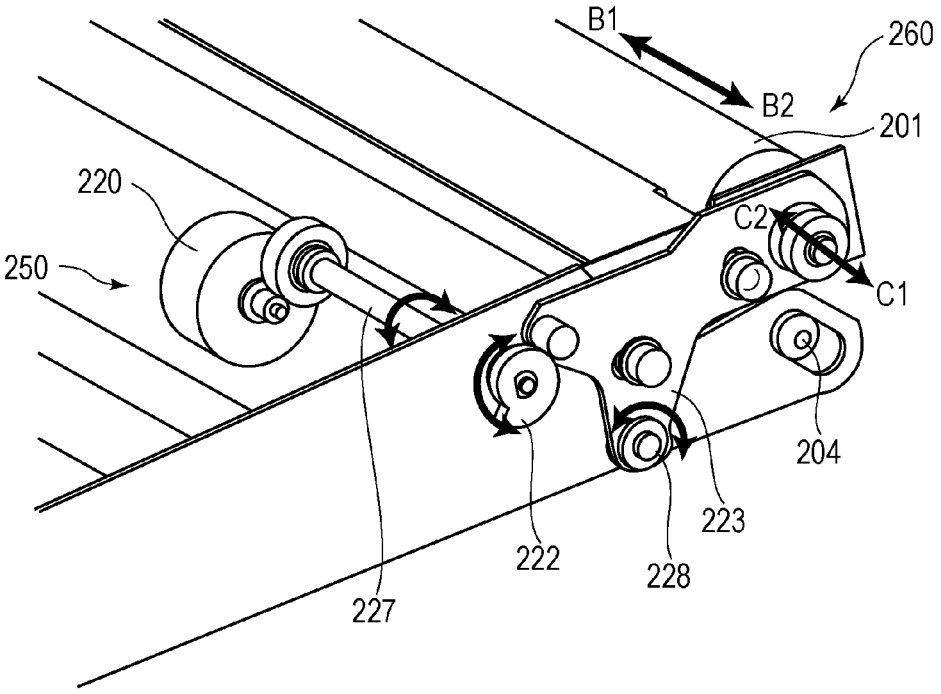

FIG. 3 is a schematic perspective view of the drive roller (hereinafter, referred to as a steering roller) 201 and peripheral portions thereof viewed from the front side (the intermediate transfer belt 106 is not illustrated). FIG. 4A is a schematic perspective view of a steering drive unit 250, which is described later, and peripheral portions thereof viewed from the front side. FIG. 4B is a schematic perspective view of the steering drive unit 250 and peripheral portions thereof viewed from the rear side. In FIGS. 4A and 4B, the intermediate transfer belt 106 are not illustrated.

In this embodiment, a steering mechanism 260 controls the belt position by changing the position of the steering roller 201 with respect to the secondary transfer opposing roller 203 (first roller). A front end portion of the steering roller 201 in the rotational axis direction is rotatably supported by the frame 240 with a bearing (not illustrated) therebetween. In addition, a rear end portion of the steering roller 201 in the rotational axis direction is rotatably supported by a steering arm 223, which is a supporting member, with a bearing therebetween. The steering arm 223 is supported by the frame 240 in a turnable (swingable) manner about a turn shaft 228 positioned on a rear side surface of the frame 240. In addition, an eccentric cam 222 is disposed on the rear side surface of the frame 240. The steering arm 223 is biased so as to be in contact with the eccentric cam 222. A steering motor 220, which is a drive source, rotates the eccentric cam 222 through a steering cam shaft 227. The steering arm 223 is turned when the eccentric cam 222 is rotated. The angular position of the steering arm 223 in the turning direction is determined by the stop position of the eccentric cam 222. In this way, the steering arm 223 moves the end portion of the steering roller 201, which is positioned on the rear side in the rotational axis direction, in the up-down direction on the predetermined tilting trajectory (substantially arc shape). This configuration enables the steering roller 201 to tilt about the bearing, which supports the end portion on the front side in the rotational axis direction, on the predetermined tilting trajectory. In this embodiment, the steering motor 220, the steering cam shaft 227, and the eccentric cam 222 constitute the steering drive unit 250.

The intermediate transfer unit 200 further includes a belt position detection mechanism 230 to detect the belt position. In this embodiment, the belt position detection mechanism 230 includes a sensor flag portion (hereinafter, simply referred to as a flag) 224 and a sensor 226 including a plurality of transmissive photointerrupters. The flag 224 is supported in a turnable (swingable) manner about a flag rotation shaft 224*c*. The flag 224 has a contact portion 224*a* at its one end and a light blocking portion 224*b*, which blocks a light of the photointerrupter in the sensor 226 depending on the angular position in the turn direction of the flag 224, at the other end. The flag 224 is biased by a torsion coil spring 225, which is an elastic member as a biasing unit, such that the contact portion 224*a* is turned so as to come in contact with a front end surface (edge) of the intermediate transfer belt 106. When the belt deviation is caused by the traveling of the intermediate transfer belt 106, the flag 224 turns in connection with the displacement of the intermediate transfer belt 106. The turn of the flag 224 is detected by the sensor 226. In other words, the flag 224 blocks the light of the photointerrupters of the sensor 226 in accordance with the belt position, and a combination of output signals from the photointerrupter of the sensor changes. A control unit 251 activates the steering motor 220 to rotate the eccentric cam 222 based on the output signals, causing the steering arm 223 to turn. This enables the steering roller 201 to be tilted on the tilting trajectory defined by the steering arm 223 such that the intermediate transfer belt 106 moves in the width direction back to substantially the middle position.

Figure 5A:
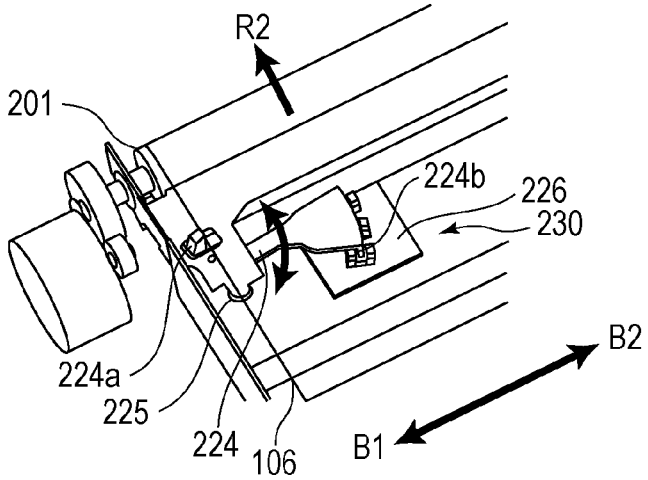
FIGS. 5A to 5C are schematic perspective views indicating an operation of a steering mechanism.
Figure 5B:
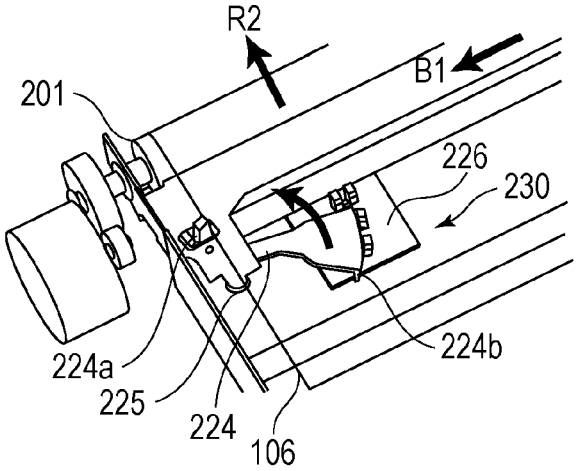
Figure 5C:
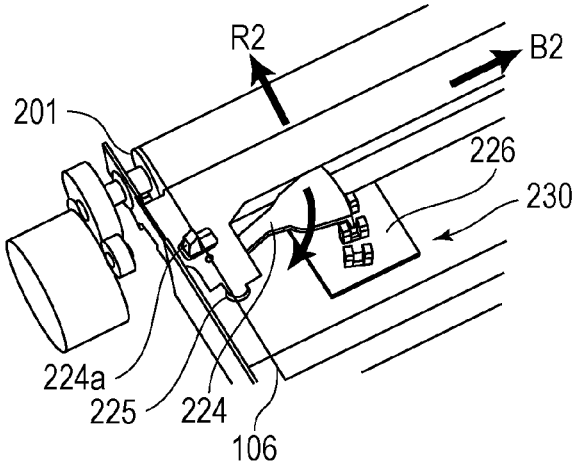

FIGS. 5A to 5C are schematic perspective views illustrating an operation of the steering mechanism 260. FIG. 5A indicates a state in which the belt position is positioned at substantially the middle. FIG. 5B indicates a state in which the belt position is displaced to the rear side. FIG. 5C indicates a state in which the belt position is displaced to the front side. As illustrated in FIG. 5B, if the belt position is displaced to the rear side, the rear end portion of the steering roller 201 is moved in the direction indicated by an arrow C1 (downwardly) in FIG. 4B. This moves the intermediate transfer belt 106 to the front side as indicated by an arrow B1 in FIGS. 4A and 4B and FIG. 5B. In addition, if the belt position is displaced to the front side as illustrated in FIG. 5C, the rear end portion of the steering roller 201 is moved in a direction indicated by an arrow C2 (upwardly) in FIG. 4B. This moves the intermediate transfer belt 106 to the rear side as indicated by an arrow B2 in FIGS. 4A and 4B and FIG. 5C. As described above, since the steering mechanism 260 causes the steering roller 201 to tilt based on the detection result of the belt position detection mechanism 230, the belt position is corrected to the substantially middle.

In this embodiment, the steering arm 223, the steering drive unit 250, the belt position detection mechanism 230, and the control unit 251, for example, constitute the steering mechanism 260.

In this embodiment, a distance between the secondary transfer opposing roller 203 and the steering roller 201 in the conveyance direction of the intermediate transfer belt 106 is longer than the width of the intermediate transfer belt 106 regardless of the tilting amount (titling angle) of the steering roller 201. In addition, in this embodiment, the tilting trajectory of the steering roller 201 is set such that the rotational axes of the support rollers other than the steering roller 201 are arranged substantially parallel to each other regardless of the tilting amount (tilting angle) of the steering roller 201. Here, "substantially parallel" includes a state in which the angle defined between the rotational axis of the tension roller 204 and the rotational axis of each support roller 202 and 203, which are support rollers other than the steering roller 201 and the tension roller 204, is 5 degrees or less. In this embodiment, one end portion of the steering roller 201 is supported in a turnable manner about the axis intersecting (in this embodiment, substantially perpendicular to) the rotation axis of the steering roller 201. In addition, in this embodiment, another end portion of the steering roller 201 is supported in a rotatable manner by the steering arm 223, which is turnable about the axis substantially perpendicular to the rotation axis of the secondary transfer opposing roller 203. This configuration enables the other end of the steering roller 201 to move on the arc-like movement trajectory. In particular, in this embodiment, the tilting trajectory (the movement trajectory of the above-described other end is described as an example) extends in the direction described below. The movement trajectory extends, when viewed in the width direction of the intermediate transfer belt 106, in a direction intersecting both of a surface of the intermediate transfer belt 106 between the secondary transfer opposing roller 203 and the steering roller 201 and a surface of the intermediate transfer belt 106 between the steering roller 201 and the tension roller 204.

4. Tension Roller

Figure 6A:
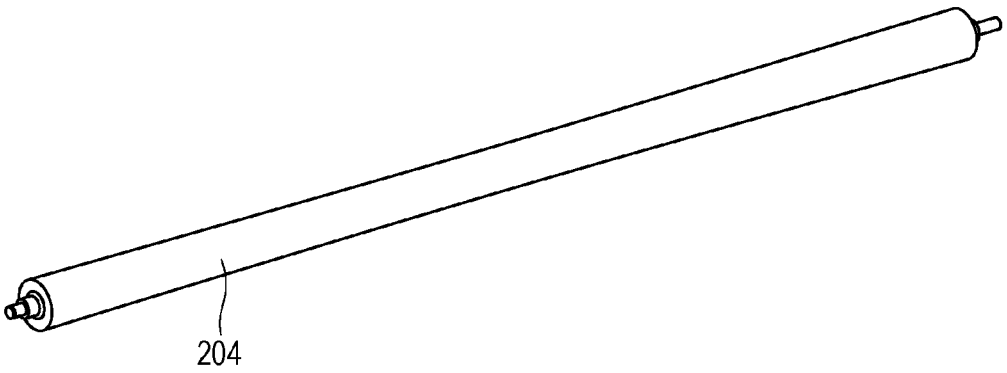
FIGS. 6A and 6B are respectively a perspective view and a cross-sectional view of a tension roller according to an embodiment of the present invention.
Figure 6B:
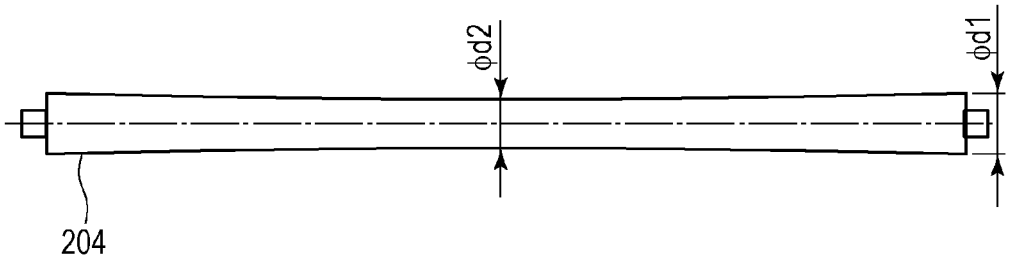

Next, the tension roller 204 is described further in detail. FIG. 6A is a perspective view of the tension roller 204. FIG. 6B is a cross-sectional view of the tension roller 204.

The tension roller 204 (second roller) is a reverse crown roller, which has a reverse crown shape in which each end portion in the rotational axis direction has a larger outer diameter than a middle portion. More specifically, in this embodiment, the tension roller 204 is a reverse crown roller having a reverse crown shape having an outer diameter gradually increases from the middle toward each end in the rotational axis direction by a constant radius. The reverse crown amount is indicated by ($\phi d1-\phi d2$), which is a difference between the maximum outer diameter and the minimum outer diameter, where $\phi d1$ is the maximum outer diameter (an outer diameter of the end portion) of the tension roller 204 and $\phi d2$ is the minimum outer diameter (an outer diameter of the middle portion).

In FIGS. 6A and 6B, the reverse crown shape are exaggerated. Here, the middle portion and the end portions of the tension roller 204 are middle and end portions in the rotational axis direction of the tension roller 204 in an area of the tension roller 204 to be in contact with (wound around) the intermediate transfer belt 106.

The tension roller 204 is disposed adjacent to and downstream of the steering roller (upstream roller) 201 in the conveyance direction of the intermediate transfer belt 106. The tension roller 204 biases (presses) against the intermediate transfer belt 106 from the inner surface side toward the outer surface side at the both end portions in the rotational axis direction. With this configuration, the tension roller 204 applies tension to the intermediate transfer belt 106 to eliminate the difference in the circumferential length of the intermediate transfer belt 106 in the width direction, which is caused by the tilting of the steering roller 201.

Figure 7:
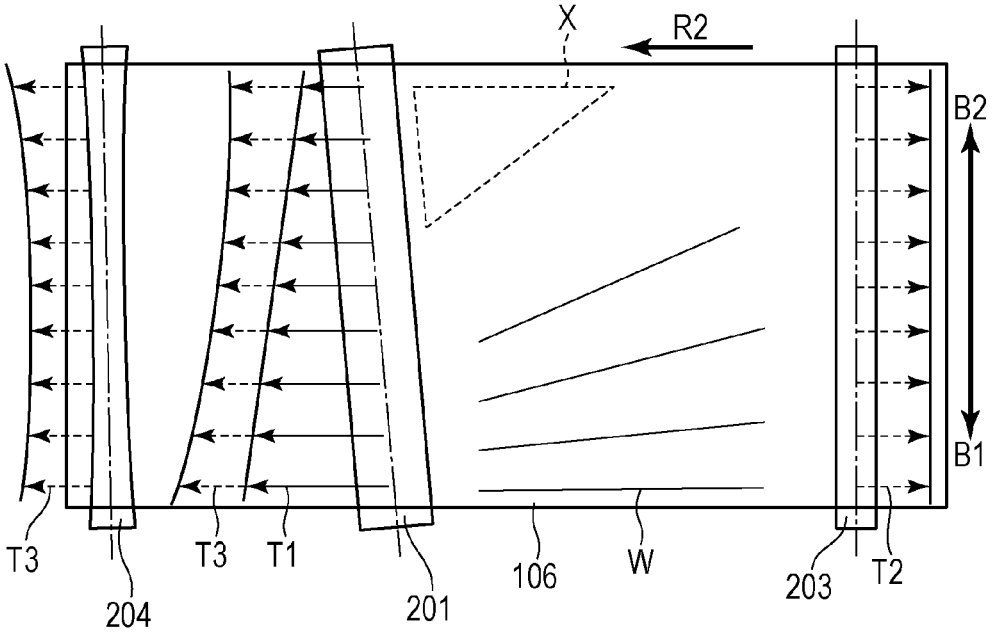
FIG. 7 is a schematic view indicating a tension distribution in an intermediate transfer belt according to an embodiment of the present invention.

FIG. 7 is a schematic view indicating a tension distribution in a surface of the intermediate transfer belt 106 extending between the secondary opposing roller 203 and the tension roller 204 when the steering roller 201 is tilted in the direction indicated by the arrow C1 in FIG. 4B in this embodiment. In FIG. 7, the intermediate transfer belt 106 is exploded in the conveyance direction thereof.

Figure 8:
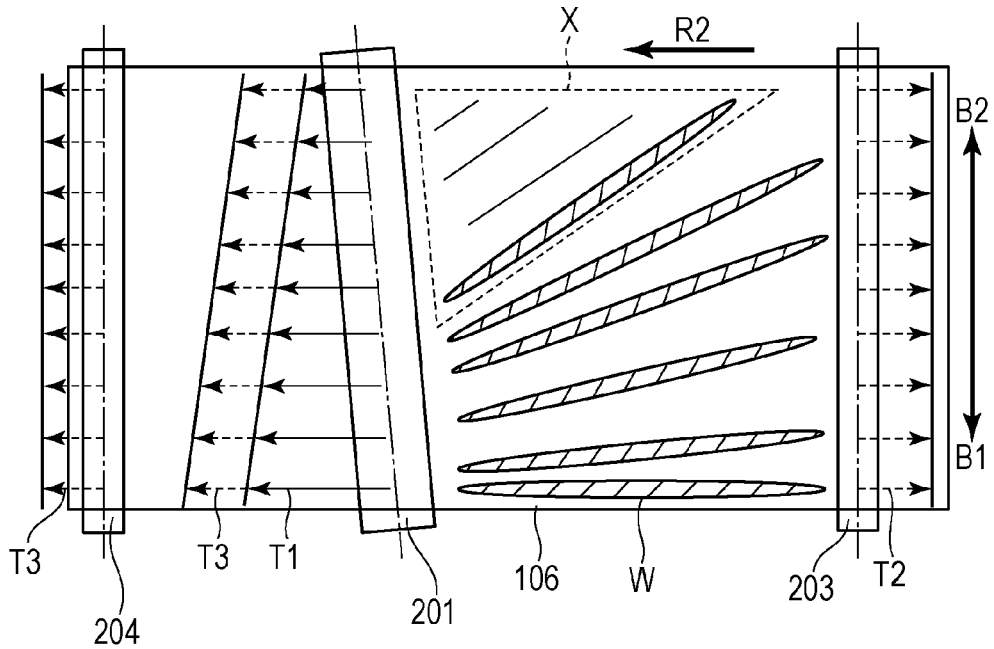
FIG. 8 is a schematic view indicating a tension distribution in an intermediate transfer belt according to a comparative example.

In addition, FIG. 8, which corresponds to FIG. 7, is a schematic view of a comparative example which employs a cylindrical (straight) tension roller 204 having substantially a constant outer diameter over the entire length in the rotational axis direction. The intermediate transfer unit 200 of the comparative example has a configuration substantially identical to that of the first embodiment except for the tension roller 204 above-described configuration. The components of the comparative example identical to those of the first embodiment are assigned the same reference numerals as those of the first embodiment.

The steering roller 201 may be tilted in a direction indicated by the arrow C1 in FIG. 4B to move the belt position in a direction indicated by an arrow B1 in FIG. 7 and FIG. 8. Such a case is discussed. In such a case, tension T1 applied by the steering roller 201 is higher toward a downstream side in the movement direction of the belt position (lower side in FIG. 7 and FIG. 8). The larger the tilting amount of the steering roller 201, the larger the difference in the tension T1 in the width direction of the intermediate transfer belt 106. Tension T2, which is applied to a position around the secondary transfer opposing roller 203, is substantially evenly distributed in the width direction of the intermediate transfer belt 106.

As illustrated in FIG. 8, when the tension roller 204 is straight (comparative example), tension T3, which is applied to a portion of the intermediate transfer belt 106 close to the tension roller 204, is substantially evenly distributed in the width direction of the intermediate transfer belt 106. Thus, the stretched surface of the intermediate transfer belt 106 between the steering roller 201 and the secondary transfer opposing roller 203 has a difference in the distribution of the tension, which is applied in the conveyance direction of the intermediate transfer belt 106, at end portions in the width direction of the intermediate transfer belt 106. As a result, a radial wave W is generated to extend from a portion of the stretched surface adjacent to the steering roller 201, at which the tension is high (lower side in FIG. 8), toward an upstream side in the conveyance direction of the intermediate transfer belt 106, and thus the stretched surface has an area X where the tension is low. In particular, the wave W tends to have a higher and steeper shape as the length of the stretched surface in the direction of tension, i.e., the length of the intermediate transfer belt 106 in the conveyance direction, is longer than the width of the intermediate transfer belt 106.

Contrary to this, as illustrated in FIG. 7, when the tension roller 204 has a reverse crown shape (the embodiment of the present invention), the tension T3 applied by the tension roller 204 is higher at end portions in the rotational axis direction of the tension roller 204, which have the larger outer diameter, than at the middle portion in the rotational axis direction. With this configuration, the difference in tension in the width direction of the intermediate transfer belt 106 at a portion close to the steering roller 201 is smaller than that in the case of FIG. 8. In addition, this configuration has a smaller area X, where the tension in the stretched surface of the intermediate transfer belt 106 between the steering roller 201 and the secondary transfer opposing roller 203 is low, than in the case of FIG. 8. As a result, the occurrence of the wave W, which is caused in the stretched surface by the tilting of the steering roller 201, is suppressed. Thus, the buckling of the portion of the intermediate transfer belt 106 to be wound around the steering roller 201 is reduced, reducing the image defect due to the bent intermediate transfer belt 106. Here, as illustrated in FIG. 7, in the end portion (lower portion in FIG. 7) in the width direction of the intermediate transfer belt 106, where the tension T1 is high, the tension T3 is also high compared to the middle portion. However, in the configuration illustrated in FIG. 7, the ratio of the distribution of the tension T3 with respect to the tension T1 is more equalized than in the case of FIG. 8. Thus, the configuration illustrated in FIG. 7 has the above-described advantages.

The waving is more suppressed as the reverse crown amount (ϕd1−ϕd2) is larger. However, if the reverse crown amount is too large, it is difficult to wind the intermediate transfer belt 106 around the tension roller 204 over the entire area in the width direction of the intermediate transfer belt 106. In addition, in general, if a support roller for supporting the belt in a tensioned state having a reverse crown shape is employed, the shape increases the deviation amount of the belt when the belt is displaced to one side in the width direction. Thus, if the reverse crown amount of the tension roller 204 is too large, the belt deviation may be difficult to be corrected by the tilting of the steering roller 201. In view of this, the reverse crown amount of the tension roller 204 can be about a few hundred μm (200 μm to 600 μm, for example) when the length in the rotational axis direction of the tension roller 204 is 350 mm, the outer diameter of the end portion in the rotational axis direction is ϕ20 mm. In this embodiment, the length in the rotational axis direction of the tension roller 204 and the outer diameter of the end portion in the rotational axis direction are described as above, and the reverse crown amount is 400 μm.

As described above, in this embodiment, the tilting of the steering roller 201 causes the tension roller 204 to correct the difference in the circumferential length of the intermediate transfer belt 106 in the width direction of the intermediate transfer belt 106. In addition, the reverse crown shape of the tension roller 204 reduces the difference in tension of the stretched surface, which is positioned upstream of the steering roller 201 in the conveyance direction of the intermediate transfer belt 106, over the area in the width direction, reducing the occurrence of the waving in the stretched surface. With this configuration, the belt position is properly corrected by the steering roller 201, and the buckling of the intermediate transfer belt 106 at the portion to be wound around the steering roller 201 is suppressed, and thus the high image quality is obtained. According to this embodiment, the waving of the intermediate transfer belt 106 due to the difference in the tension in the width direction of the intermediate transfer belt 106, which is caused by the tilting of the steering roller 201, is reduced.

Second Embodiment

Next, another embodiment of the present invention is described. The basic configuration and operation of the image forming apparatus according to this embodiment are identical to those of the first embodiment. Thus, the components of the image forming apparatus in this embodiment having the functions and configurations identical or corresponding to those of the image forming apparatus in the first embodiment are assigned the same reference numerals as those of the image forming apparatus in the first embodiment, and are not described in detail.

1. Effect of Reverse Crown Shape of Tension Roller on Color Misalignment

An effect of the reverse crown shape of the tension roller 204 on the color misalignment is described.

Figure 12:
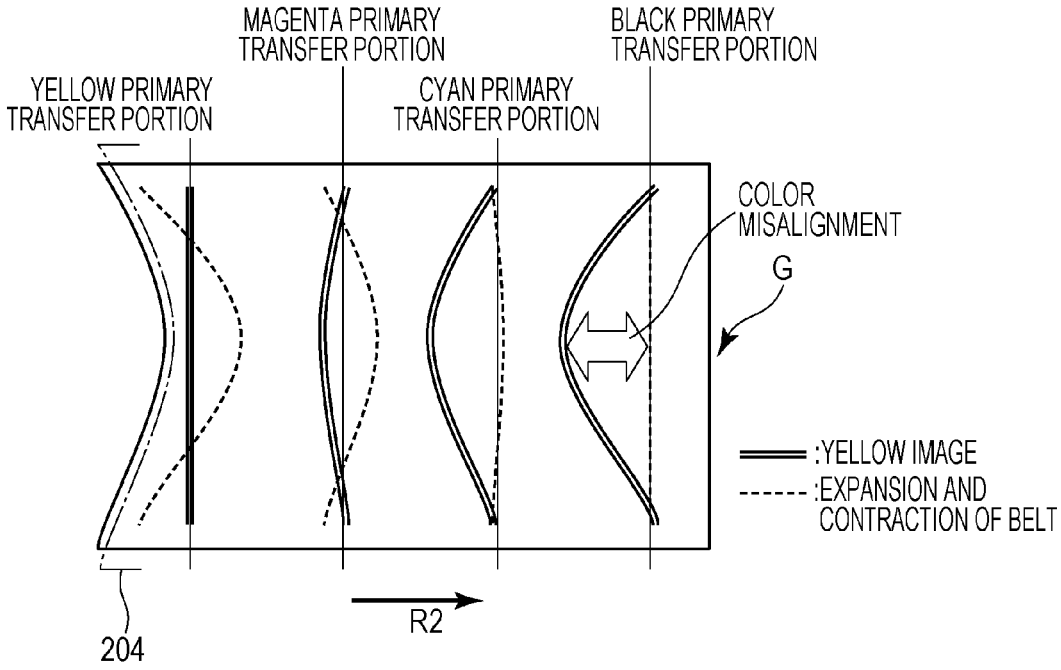
FIG. 12 is a schematic view for explaining a generation mechanism of color misalignment.

FIG. 12 is a schematic view indicating a relationship between expansion and contraction of the intermediate transfer belt 106 and the image at the image transfer surface (primary transfer surface) G in the configuration of the first embodiment. In FIG. 12, the intermediate transfer belt 106 is exploded in the conveyance direction thereof, and the image transfer surface G is viewed from below. The effect due to the reverse crown shape of the tension roller 204 is exaggerated. In FIG. 12, broken lines indicate changes in the expansion and contraction of the intermediate transfer belt 106 in the conveying process of the intermediate transfer belt 106, and double lines indicate changes in the yellow image in the conveying process. Here, the image is a straight line extending in the rotational axis direction (main scanning direction) of the photosensitive drum 101.

The tension of the image transfer surface G of the intermediate transfer belt 106 in the width direction is desired to be substantially constant while the intermediate transfer belt 106 is travelling, so as to reduce an image defect such as color misalignment. However, since the intermediate transfer belt 106 changes its shape to fit the reverse crown shape of the tension roller 204, the front side, the rear side, and the middle in the width direction of the intermediate transfer belt 106 may be different in the amount of expansion and contraction in the conveyance direction as illustrated in FIG. 12. The primary transfer portion for yellow N1Y, which is closest to the tension roller 204 in the conveyance direction of the intermediate transfer belt 106, has the largest difference in the expansion and contraction, and the difference becomes smaller as closer to the downstream side. Thus, the image transferred from the photosensitive drum for yellow 101Y to the intermediate transfer belt 106 gradually curves with the changes in the expansion and contraction of the intermediate transfer belt 106 until reaches the primary transfer portion for black N1K.

Since the image transferred from the photosensitive drum for black 101K to the intermediate transfer belt 106 is a straight line, the position of the yellow image and the position of the black image are misaligned at the middle in the width direction of the intermediate transfer belt 106. The color misalignment in a direction (sub scanning direction) substantially perpendicular to the conveyance direction of the intermediate transfer belt 106 occurs in this way.

To reduce the color misalignment in the above-described sub scanning direction, this embodiment employs a crown roller as the auxiliary roller 205.

2. Auxiliary Roller

Figure 9A:
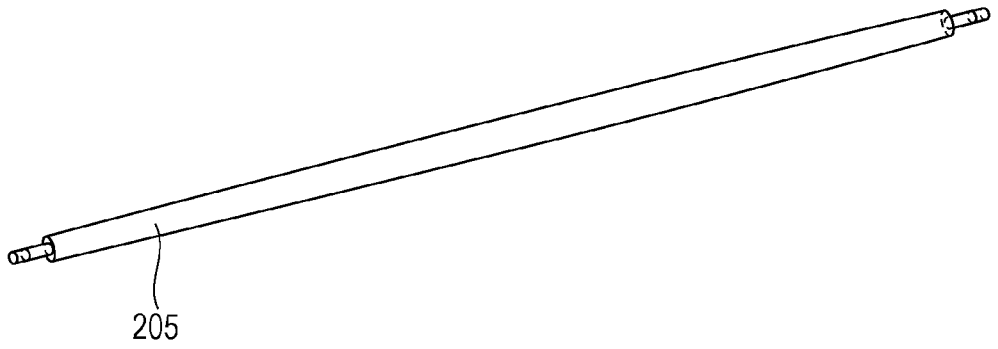
FIGS. 9A and 9B are respectively a perspective view and a cross-sectional view of an auxiliary roller according to another embodiment of the present invention.

Next, the auxiliary roller 205 (third roller) is described further in detail. FIG. 9A is a perspective view of the auxiliary roller 205 in this embodiment, and FIG. 9B is a cross-sectional view of the auxiliary roller 205 in this embodiment.

The auxiliary roller (downstream roller) 205 is disposed adjacent to and downstream of the tension roller 204 and upstream of the image transfer surface G in the conveyance direction of the intermediate transfer belt 106. More specifically, in the conveyance direction of the intermediate transfer belt 106, the auxiliary roller 205 is disposed adjacent to and downstream of the tension roller 204 and upstream of the primary transfer portion N1Y, which is the most upstream one of the primary transfer portions N1. In this embodiment, the auxiliary roller 205 is a crown roller having a crown shape in which end portions in the rotational axis direction each have a smaller outer diameter than the middle portion. More specifically, in this embodiment, the auxiliary roller 205 is a crown roller having a crown shape having an outer diameter gradually decreases from the middle toward each end in the rotational axis direction by a constant radius. The crown amount is indicated by (ϕd4−ϕd3), which is a difference between the maximum outer diameter and the minimum outer diameter, where ϕd3 is the minimum outer diameter (an outer diameter of the end portion) of the auxiliary roller 205 and ϕd4 is the maximum outer diameter (an outer diameter of the middle portion).

Figure 9B:
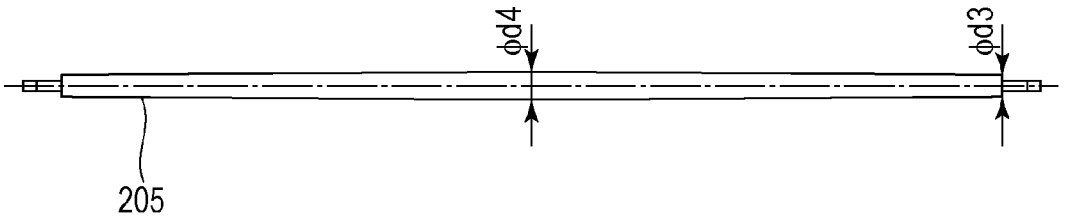

In FIGS. 9A and 9B, the crown shape are exaggerated. Here, the middle portion and the end portions of the auxiliary roller 205 are middle and end portions in the rotational axis direction of the auxiliary roller 205 in an area of the auxiliary roller 205 to be in contact with (wound around) the intermediate transfer belt 106.

Figure 10:
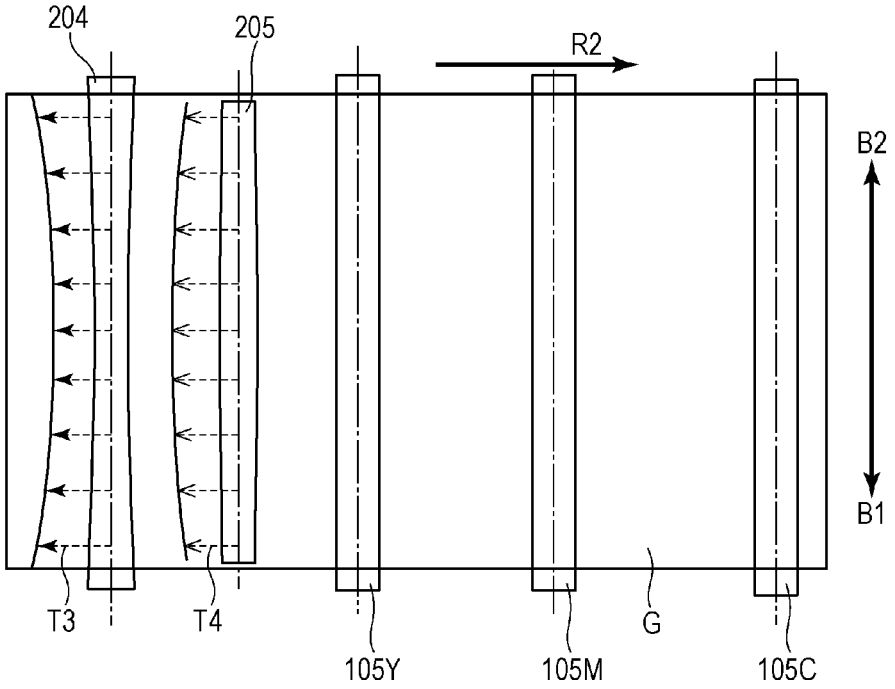
FIG. 10 is a schematic view indicating a tension distribution in an intermediate transfer belt at a position close to an image transfer surface according to another embodiment of the present invention.

FIG. 10 indicates a tension distribution in the intermediate transfer belt 106 at a portion close to the image transfer surface G in a case in which the auxiliary roller 205 is a crown roller. In FIG. 10, the intermediate transfer belt 106 is exploded in the conveyance direction thereof, and the image transfer surface G is viewed from above. When the auxiliary roller 205, which is a crown roller, sends the intermediate transfer belt 106, tension T4 applied to the intermediate transfer belt 106 is high at the middle portion of the auxiliary roller 205 in the rotational axis direction. Thus, the difference in the tension T3 applied by the tension roller 204, which is the reverse crown roller, in the width direction of the intermediate transfer belt 106 is eliminated by the distribution of the tension T4 applied by the auxiliary roller 205. With this configuration, the difference in the tension on the image transfer surface G in the width direction of the intermediate transfer belt 106 is reduced even when the tension roller 204, which is disposed upstream of the image transfer surface G in the conveyance direction of the intermediate transfer belt 106, has the reversed crown shape, leading to a reduction in the image defect such as color misalignment. Hereinafter, this is described further in detail.

The crown amount of the auxiliary roller 205 is desired to be set such that the reverse crown shape of the tension roller 204 sufficiently eliminates the difference in the expansion and contraction of the intermediate transfer belt 106 in the width direction, which is caused by the reverse crown shape of the tension roller 204. In this embodiment, since the tension roller 204 is biased by the tension spring 208 at each end portion in the rotational axis direction, the tension roller 204 warps a little. Thus, the difference in the expansion and contraction of the intermediate transfer belt 106 in the width direction tends to be larger than the reverse crown amount of the tension roller 204. Thus, the crown amount of the auxiliary roller 205 can be set to be larger than the reverse crown amount of the tension roller 204. In this embodiment, the reverse crown amount of the tension roller 204 is 400 μm, and the crown amount of the auxiliary roller 205 is 500 μm.

Figure 11:
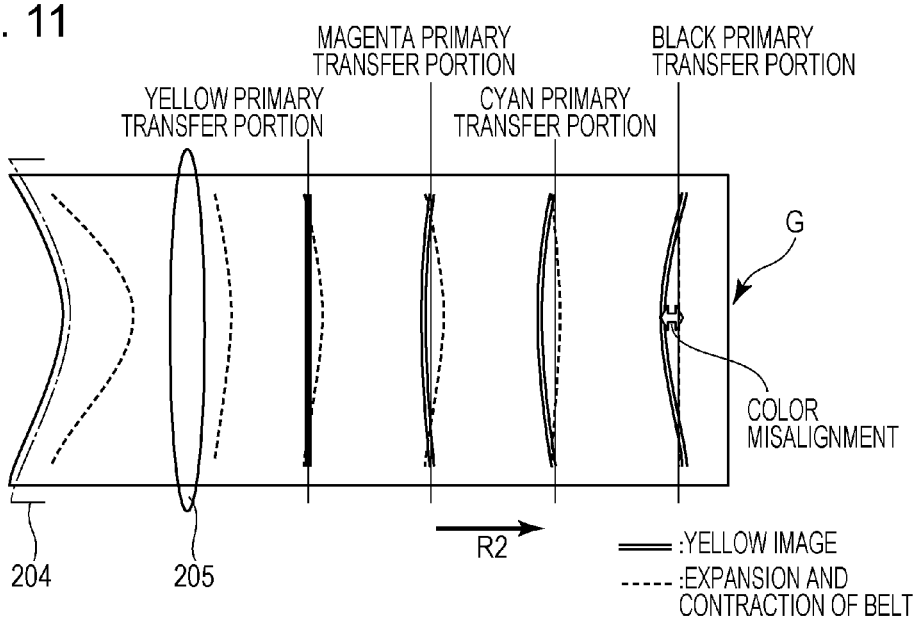
FIG. 11 is a schematic view indicating a relationship between expansion and contraction of the intermediate transfer belt and an image according to another embodiment of the present invention.

FIG. 11 is a schematic view indicating a relationship between the expansion and contraction of the intermediate transfer belt 106 and the image at the image transfer surface G. In FIG. 11, the intermediate transfer belt 106 is exploded in the conveyance direction thereof, and the image transfer surface G is viewed from below. The effect due to the reverse crown shape of the tension roller 204 and the crown shape of the auxiliary roller 205 is exaggerated. In FIG. 11, broken lines indicate changes in the expansion and contraction of the intermediate transfer belt 106 in the conveying process of the intermediate transfer belt 106, and double lines indicate changes in the yellow image in the conveying process. Here, the image is a straight line extending in the rotational axis direction (main scanning direction) of the photosensitive drum 101.

As illustrated in FIG. 11, the crown shape of the auxiliary roller 205 eliminates the difference in the expansion and contraction of the intermediate transfer belt 106 in the width direction, which is caused by the reverse crown shape of the tension roller 204, in an area between the auxiliary roller 205 and the primary transfer portion for yellow N1Y. This reduces the image defect such as the color misalignment due to the difference in the expansion and contraction of the intermediate transfer belt 106 in the width direction. The amount of the color misalignment reduced by the configuration in this embodiment is estimated to be 60% or more.

As described above, this embodiment reduces the waving of the intermediate transfer belt 106, which is caused by the steering operation, and the image defect such as the color misalignment, which is caused by the difference in the expansion and contraction of the intermediate transfer belt 106 in the width direction at the image transfer surface G. Thus, this embodiment is more advantageous in the formation of a high-quality image than the first embodiment.

Others

Although the present invention has been described using the specific embodiments, the present invention is not limited to the above-described embodiments.

The above-embodiments include the four image forming sections, but the number of the image forming sections is not limited to four and may be more than or less than four. In addition, the alignment sequence of the image forming sections for yellow, magenta, cyan, and black is not limited to that in the above-described embodiments.

In addition, in the above-described embodiments, the intermediate transfer belt is supported by the five support rollers in a tensioned state. However, the number of the support rollers used to support the intermediate transfer belt in a tensioned state is not limited to five, and may be more than or less than five.

In addition, in the above-described embodiments, the image transfer surface is provided between the auxiliary roller (downstream roller) and the idler roller, which is positioned upstream of the secondary transfer opposing roller (upstream roller) in the conveyance direction of the intermediate transfer belt, but the present invention is not limited to this configuration. For example, the image transfer surface may be provided between the auxiliary roller (downstream roller) and the secondary transfer opposing roller (upstream roller). In addition, in the above-described embodiments, the auxiliary roller is disposed adjacent to and downstream of the tension roller in the conveyance direction of the intermediate transfer belt, but the present invention is not limited to this configuration. An additional support roller may be disposed between the tension roller and the auxiliary roller (downstream roller). For example, an auxiliary roller (downstream roller) having a crown shape may be disposed downstream of the tension roller in the conveyance direction of the intermediate transfer belt and upstream of the primary transfer portion (specifically, the most upstream one of the primary transfer portions). This configuration provides the same advantage as that in the second embodiment.

Figure 13:
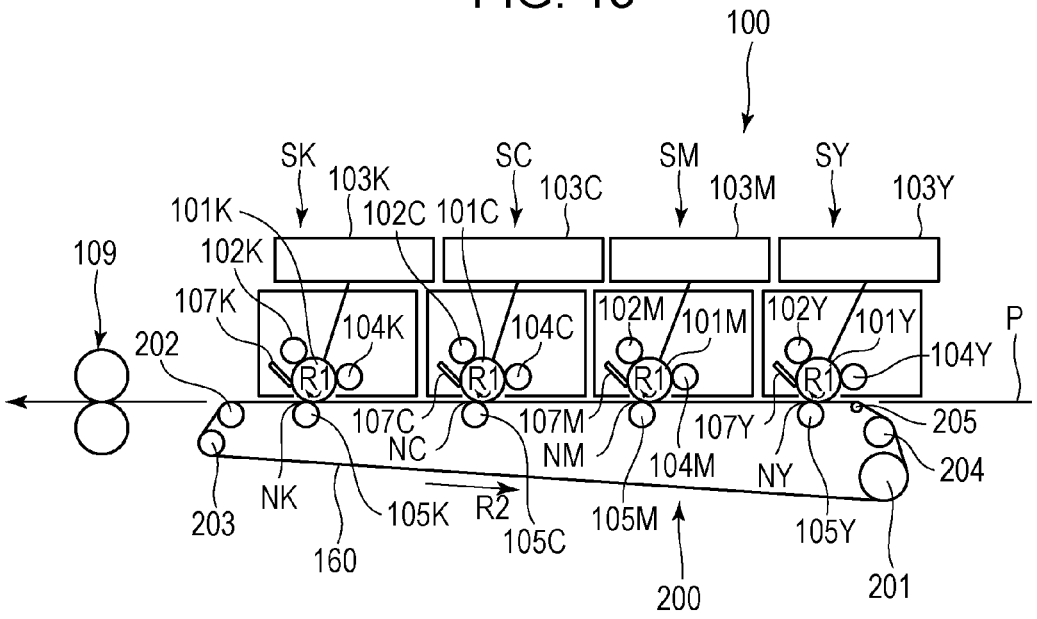
FIG. 13 is a schematic cross-sectional view of the main components of an image forming apparatus according to one of other embodiments.

In addition, in the above-described embodiments, the image forming apparatus using the intermediate transfer process is described as an example, but the present invention is applicable to an image forming apparatus using a direct transfer process. FIG. 13 is a schematic cross-sectional view of the main components of an image forming apparatus using a direct transfer process. In FIG. 13, the components having the functions and configurations identical or corresponding to those of the image forming apparatus illustrated in FIG. 1 are assigned the same reference numerals as those in FIG. 1. An image forming apparatus 100 in FIG. 13 includes a recording material carrying belt 160, which is an endless belt as a recording material carrier, instead of the intermediate transfer belt 106 of the image forming apparatus 100 in FIG. 1. In the image forming apparatus 100 in FIG. 13, the toner image formed on the photosensitive drum 101 at each image forming section S is transferred to the recording material P, which is carried and conveyed by the recording material carrying belt 160, at each transfer portion N. In such an image forming apparatus 100 using the direct transfer process, it is desired to prevent the recording material carrying belt 160 from having a crease, which is caused by the waving due to the steering operation, so as to properly convey the recording material P. In addition, it is desired to reduce the difference in expansion and contraction of the recording material carrying belt 160 in the width direction on the image transfer surface G so as to properly transport the recording material P on the image transfer surface (recording material carrying surface) G. Therefore, the waving and the difference in the expansion and contraction are reduced in the image forming apparatus 100 using the direct transfer process by employing the configurations in the above-described first and second embodiments. In addition, the present invention is applicable to a belt conveyance apparatus, in which a belt is a photosensitive belt or an electrostatic recording dielectric belt, and to an image forming apparatus including the belt conveyance apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-171507, filed Aug. 31, 2015, which is hereby incorporated by reference herein in its entirety.

What is claimed is:

1. A belt conveyance apparatus comprising:

an endless belt carrying a toner image; and a plurality of support rollers supporting the endless belt from an inner surface side of the endless belt in a tensioned state, the plurality of support rollers including a steering roller, a first roller, and a second roller, wherein the steering roller is configured to move the endless belt in a width direction of the endless belt intersecting a traveling direction of the endless belt when tilted with respect to the first roller, the first roller is disposed adjacent to and upstream of the steering roller in the traveling direction, and the second roller is disposed adjacent to and downstream of the steering roller in the traveling direction, the second roller having a reverse crown shape in which end portions in a rotational axis direction each have a larger outer diameter than a middle portion.

2. The belt conveyance apparatus according to claim 1, wherein an area of the endless belt extending between the first roller and the steering roller has a length in the traveling direction larger than a length of the endless belt in the width direction.

3. The belt conveyance apparatus according to claim 1, wherein rotational axes of the first roller and the second roller are substantially parallel to each other.

4. The belt conveyance apparatus according to claim 1, wherein the steering roller has an end portion in a rotational axis direction supported in a turnable manner about an axis intersecting a rotational axis of the steering roller and another end portion supported in a rotatable manner by a supporting member.

5. The belt conveyance apparatus according to claim 1, wherein the plurality of support rollers include a third roller disposed adjacent to and downstream of the second roller in the traveling direction, and the third roller has a crown shape in which end portions in the rotational axis direction each have a smaller outer diameter than a middle portion.

6. The belt conveyance apparatus according to claim 5, wherein a crown amount of the crown shape of the third roller is larger than a reverse crown amount of the reverse crown shape of the second roller.

7. The belt conveyance apparatus according to claim 1, wherein the steering roller is configured to apply a driving force to the endless belt when rotated.

8. An image forming apparatus comprising:

an endless belt;

a toner image forming unit configured to form a toner image on the endless belt; and a plurality of support rollers supporting the endless belt from an inner surface side of the endless belt in a tensioned state, the plurality of support rollers including a steering roller, a first roller, and a second roller, wherein the steering roller is configured to move the endless belt in a width direction of the endless belt intersecting a traveling direction of the endless belt when tilted with respect to the first roller, the first roller is disposed adjacent to and upstream of the steering roller in the traveling direction, and the second roller is disposed adjacent to and downstream of the steering roller in the traveling direction, the second roller having a reverse crown shape in which end portions in a rotational axis direction each have a larger outer diameter than a middle portion.

9. The image forming apparatus according to claim 8, wherein an area of the endless belt extending between the first roller and the steering roller has a length in the traveling direction larger than a length of the endless belt in the width direction.

10. The image forming apparatus according to claim 8, wherein rotational axes of the first roller and the second roller are substantially parallel to each other.

11. The image forming apparatus according to claim 8, wherein the steering roller has an end portion in a rotational axis direction supported in a turnable manner about an axis intersecting a rotational axis of the steering roller and another end portion supported in a rotatable manner by a supporting member.

12. The image forming apparatus according to claim 8, wherein the plurality of support rollers include a third roller disposed adjacent to and downstream of the second roller in the traveling direction, and the third roller has a crown shape in which end portions in the rotational axis direction each have a smaller outer diameter than a middle portion.

13. The image forming apparatus according to claim 12, wherein a crown amount of the crown shape of the third roller is larger than a reverse crown amount of the reverse crown shape of the second roller.

14. The image forming apparatus according to claim 8, wherein the steering roller is configured to apply a driving force to the endless belt when rotated.

15. The image forming apparatus according to claim 1, further comprising:

bearing members configured to rotatably support the second roller by respectively being provided to either end of the second roller in the width direction; and a biasing member configured to bias each of the bearing members, wherein the second roller is biased by the biasing member from the inner surface side of the endless belt toward the outer surface side.

16. The image forming apparatus according to claim 8, further comprising:

bearing members configured to rotatably support the second roller by respectively being provided to either end of the second roller in the width direction; and a biasing member configured to bias each of the bearing members, wherein the second roller is biased by the biasing member from the inner surface side of the endless belt toward the outer surface side.

17. A belt conveyance apparatus comprising:

an endless belt carrying a toner image; and a plurality of support rollers supporting the endless belt from an inner surface side of the endless belt in a tensioned state, the plurality of support rollers including a steering roller, a first roller, and a second roller, wherein the steering roller is configured to move the endless belt in a width direction of the endless belt intersecting a traveling direction of the endless belt when tilted with respect to the first roller, the first roller is disposed adjacent to and upstream of the steering roller in the traveling direction, and the second roller is disposed adjacent to and downstream of the steering roller in the traveling direction, the second roller being smaller in diameter at a central portion than at an end portion in the endless belt contact region thereof with respect to a rotational axis direction thereof.

18. The image forming apparatus according to claim 17, wherein the steering roller is configured to apply a driving force to the endless belt when rotated.

19. The image forming apparatus according to claim 17, further comprising:

bearing members configured to rotatably support the second roller by respectively being provided to either end of the second roller in the width direction; and a biasing member configured to bias each of the bearing members, wherein the second roller is biased by the biasing member from the inner surface side of the endless belt toward the outer surface side.

* * * * *